US010195646B2

(12) United States Patent
Kloeser et al.

(10) Patent No.: US 10,195,646 B2
(45) Date of Patent: Feb. 5, 2019

(54) SIFTER

(71) Applicant: Siempelkamp Maschinen- und Anlagenbau GmbH, Krefeld (DE)

(72) Inventors: Lars Kloeser, Krefeld (DE); Sven Knabe, Wiesbaden (DE); Eberhard Scheiffele, Wiesbaden (DE)

(73) Assignee: SIEMPELKAMP MASCLINEN-UND ANLAGENBAU GMBH, Krefeld (DE)

( * ) Notice: Subject to any disclaimer, the term of this patent is extended or adjusted under 35 U.S.C. 154(b) by 0 days.

(21) Appl. No.: 15/687,704

(22) Filed: Aug. 28, 2017

(65) Prior Publication Data

US 2018/0071784 A1 Mar. 15, 2018

(30) Foreign Application Priority Data

Sep. 15, 2016 (DE) ..... 10 2016 117 383

(51) Int. Cl.

| | |
|---|---|
| ***B07B 4/02*** | (2006.01) |
| ***B07B 7/06*** | (2006.01) |
| ***B27N 1/00*** | (2006.01) |
| ***B27N 3/18*** | (2006.01) |
| *B07B 11/06* | (2006.01) |

(52) U.S. Cl.

CPC ..... *B07B 7/06* (2013.01); *B07B 4/02* (2013.01); *B27N 1/00* (2013.01); *B27N 3/18* (2013.01); *B07B 11/06* (2013.01)

(58) Field of Classification Search

CPC .... B07B 4/02; B07B 4/04; B07B 7/02; B07B 9/00; B07B 11/02; B07B 11/06

USPC ..... 209/139.1, 142, 143, 154

See application file for complete search history.

(56) References Cited

U.S. PATENT DOCUMENTS

| | | | | |
|---|---|---|---|---|
| 1,530,277 A * | 3/1925 | Mettler, Sr. | ..... | B07B 4/04 209/137 |
| 2,210,103 A * | 8/1940 | Stoner | ..... | B07B 4/02 209/135 |
| 2,389,966 A * | 11/1945 | Erickson | ..... | B07B 7/06 209/25 |
| 5,725,102 A * | 3/1998 | Gustavsson | ..... | B07B 7/0865 209/143 |

(Continued)

FOREIGN PATENT DOCUMENTS

| | | |
|---|---|---|
| EP | 0795359 A | 9/1997 |
| EP | 1900445 A | 3/2008 |

*Primary Examiner* — Joseph C Rodriguez
(74) *Attorney, Agent, or Firm* — Andrew Wilford

(57) ABSTRACT

A sifter for separating coarse particles from a particle-carrying stream during the manufacture of wood fiber panels has a housing forming a chamber. The housing also has a material inlet for admitting the particle-carrying stream to the chamber, a front wall formed with an upper air inlet below the material inlet for admitting a respective upper air stream to the chamber and a lower air inlet below the upper inlet for admitting a respective lower air stream to the chamber, an exhaust-air outlet for conveying air and fine particles from the chamber, and a coarse-particle outlet for conveying coarse particles out of the chamber. The front wall of the housing has between the upper air inlet and the lower air inlet a portion with an inwardly concavely curved shape that forms a support vortex that supports the upper air stream entering through the upper feed air inlet in the chamber of the housing between the upper air inlet and the lower air inlet.

10 Claims, 4 Drawing Sheets

(56) References Cited

U.S. PATENT DOCUMENTS

| | | | | |
|---|---|---|---|---|
| 6,814,240 | B2 * | 11/2004 | Loth | B03B 9/061 209/219 |
| 6,978,899 | B2 * | 12/2005 | Kokko | B07B 4/04 209/639 |
| 7,051,880 | B1 * | 5/2006 | Bills | B07B 7/01 209/147 |
| 7,328,808 | B2 * | 2/2008 | Kokko | B07B 4/02 209/639 |
| 7,506,764 | B2 * | 3/2009 | Couture | B07B 4/02 209/134 |
| 8,016,117 | B2 * | 9/2011 | Althouse | B07B 4/02 209/139.1 |

* cited by examiner

SIFTER

FIELD OF THE INVENTION

The present invention relates to a sifter. More particularly this invention concerns a sifting apparatus for separating coarse particles out of an air stream carrying fine and coarse particles.

BACKGROUND OF THE INVENTION

In the manufacture of wood material panels, in particular wood fiber panels, a sifter or particle-separating apparatus has a housing having a material inlet, at least one air inlet below the material inlet, an exhaust-air outlet above the air inlet, and a coarse-particle outlet below the air inlet. An upper front wall of the sifter housing above the air inlet is oriented at least partially, i.e. over a certain vertical portion, at an acute angle to the vertical.

This type of sifter is used for cleaning particle streams in the wood-materials industry, and in particular for separating undesirable components from a particle-carrying stream. The intent is thus to remove bits of metal, coarse fibers, rust flecks, adhesive particles or clumps, for example, in order to protect downstream facilities or parts thereof, in particular the steel belts of continuously operating wood material presses, from damage. The sifter is particularly preferably used during the manufacture of wood fiber panels for separating coarse particles from the fiber stream, and thus, from the (glued) wood fibers (rubberwood fibers, for example).

Fiber panels here are medium density fiber (MDF) panels, for example. During manufacture of the fibers for wood fiber panels, the wood is initially separated into fibers in a refiner and wet-glued in a blowpipe, for example, and subsequently dried. The sifter is preferably downstream from these components, and particularly preferably downstream from the dryer of such a facility.

The sifter operates as an air sifter in that the material to be classified is introduced into the housing via the material inlet and laterally acted on by an air stream that is blown into the housing via the air inlet. The fibers are entrained by the air stream and discharged together with the air stream via the (upper) exhaust-air outlet and an exhaust air line connected thereto. Coarse particles having a fairly high weight are not entrained by the air stream and fall downward into the area of the coarse-particle outlet that may be provided with a gate so that the (undesirable) coarse particles can be discharged.

A sifter of the described type is known for example from EP 0 795 359. This sifter has a first (upper) material inlet for supplying an upper particle-carrying air stream, and a lower (lower) material inlet therebelow for supplying a lower air stream. The upper air passes into the chamber of the sifter via an upper line, and at the opening of the upper air line the particles are entrained by the air stream of the upper air and swirled upward. A high material concentration is present at the upper edge of the inflow cross section of the upper air, as a result of which it may be difficult for the air stream to entrain the fibers at these locations, in particular for large material quantities. Although even greater material quantities can be managed by the air stream by increasing the velocity of the inflowing air, which has an adverse effect on the classifying. To avoid these disadvantages, horizontal parallel fittings in the form of distribution pipes are provided at the opening of the upper air line into the sifter. The intent is for these distribution pipes to increase the vertical component of the velocity vector of the inflowing air, and for the distribution pipes to prevent material from passing into the line of the upper air and be deposited there. The intent is also to increase the classifying efficiency by additionally supplying lower air via the lower air line. Such a sifter having an upper air line and a lower air line has basically proven satisfactory in practice. However, the known embodiment is capable of refinement. This the concern for the instant invention.

Furthermore, a sifter is known from EP 1 900 445 for separating coarse and fine particles during the manufacture of wood fiber panels, in which multiple inlet openings for the classifying air, one above the other, are likewise provided. These inlet openings for the classifying air are offset in steps in order to improve the cross-flow separation in the conveying direction of the material, i.e. in the flow direction of the stream of classifying air toward the discharge opening. Three inlet openings for the classifying air, one above the other, are preferred.

Finally, U.S. Pat. No. 5,725,102 describes a sifter having "zigzag plates" and operates by both gravimetric and centrifugal action. A zigzag-shaped classifying area is delimited by a deflection line having a downstream material sorting gate so that a division into a fiber-air mixture on the one hand and air on the other hand takes place due to centrifugal forces.

OBJECTS OF THE INVENTION

It is therefore an object of the present invention to provide an improved sifter.

Another object is the provision, proceeding from the previously known prior art, and in particular EP 0 798 359, of a sifter of the type described above that is characterized by an increased classifying efficiency with a simple design and economical construction.

SUMMARY OF THE INVENTION

A sifter for separating coarse particles from a particle-carrying stream during the manufacture of wood fiber panels has a housing forming a chamber. The housing also has a material inlet for admitting the particle-carrying stream to the chamber, a front wall formed with an upper air inlet below the material inlet for admitting a respective upper air stream to the chamber and a lower air inlet below the upper inlet for admitting a respective lower air stream to the chamber, an exhaust-air outlet for conveying air and fine particles from the chamber, and a coarse-particle outlet for conveying coarse particles out of the chamber. The front wall of the housing has between the upper air inlet and the lower air inlet a portion with an inwardly concavely curved shape that forms a support vortex that supports the upper air stream entering through the upper feed air inlet in the chamber of the housing between the upper air inlet and the lower air inlet.

The lower front wall thus preferably has a convexly curved design or has at least one convexly curved section. In this case, "convexly curved" means toward the exterior of the housing. The curvature preferably extends over (essentially) the entire width of the lower front wall, and particularly preferably with an identical curvature over the width, so that a curvature about a curvature relative to a horizontal axis is implemented.

According to the invention, at least two feed air inlets situated one above the other are provided, so that on the one hand an upper air line for supplying a upper air stream, and on the other hand a lower air line for supplying a lower air stream, are provided. Between these lines or inlets, the classifier housing or its (lower) front wall is designed in such a way that a support vortex forms in the chamber to support the upper feed air stream. The classifier may thus be operated in a particularly stable and energy-efficient manner. In particular, the upper air stream may be stabilized under different loading values or fluctuating charging quantities. While the lower front wall is provided between the upper air inlet and the lower air inlet, an upper front wall is provided above the upper air inlet and thus between the material inlet and the upper air inlet, and is preferably oriented, at least partially, i.e., over a certain vertical section, at an angle with respect to the vertical.

It is advantageous for this lower (supporting) air stream, which is supplied via the lower feed air inlet, to enter the interior rising at an angle. This is achieved in that a lower feed air connector is connected to the lower air inlet and is oriented to rise at an angle with respect to the horizontal, so that a lower feed air stream is generated that enters the interior with an upwardly inclined orientation with respect to the horizontal. Alternatively or additionally, such a design may also be implemented for the upper air inlet. Thus, a upper feed air connector having a design that rises at an angle with respect to the horizontal and which generates a upper feed air stream that enters the interior with an upwardly inclined orientation with respect to the horizontal may be connected to the upper air inlet.

In one preferred refinement, the upper edge of the upper air inlet, in a side view, is situated in alignment above the lower edge of the upper air inlet or projects somewhat inward beyond the lower edge. this upper air inlet has a free inflow cross section in the interior of the classifier housing, and therefore is designed to be wholly unobstructed, without any internal fittings or distribution elements, so that the inflow cross section is not hindered by fittings, distribution elements, or the like. The same may be implemented for the lower air inlet.

The invention is based on the discovery that penetration or falling of material to be classified into the feed air inlet or the feed air line connected thereto may be reliably avoided by an appropriate design of the classifier housing or the front wall of the classifier housing, and appropriate placement of the air inlet, without the need for protective grills or such fittings in the air lines. Due to the lack of such fittings or protective grills, pressure losses may be reduced and the flow equalized, so that the classifying efficiency and/or energy efficiency are/is increased according to the invention. The upper edge of the feed air inlet particularly preferably projects by an extent M beyond the lower edge; i.e., in a side view the upper edge of the feed air inlet or a feed air line connected thereto projects, relative to the vertical, further into the interior of the classifier housing than does the lower edge. This described embodiment may be implemented either for the upper air inlet or for the lower air inlet, or also for both feed air inlets.

In addition, the upper front wall has a curved guide wall portion, particularly preferably a convexly curved guide wall portion, adjoining the upper edge of the air inlet (on top). In this case, "convexly curved" means toward the exterior of the housing. Such a curved guide wall portion preferably directly adjoins the upper edge of the air inlet, so that the upper front wall is directly connected via this curved guide wall portion to the upper edge of the air inlet and thus to the upper edge of the connected process air line. Such a curved guide wall portion ensures equalization of the air flow, and thus improves the operation and the classifying efficiency, by reducing pressure losses in the sifter. Moreover, entry of particles into the air inlet or the connected process air line is avoided due to such a curved guide wall portion.

In the sifter according to the invention, the upper front wall preferably has a vertically oriented upper wall portion that is adjoined (therebelow) by a wall portion that is inclined to the vertical. Such an embodiment is known from EP 0 798 359, for example. On this basis, however, according to the invention the curved guide wall portion described above preferably adjoins the inclined wall portion on the underside, so that for the front wall, a vertically oriented upper wall portion, a middle wall portion that is inclined to the vertical, and a curved lower guide wall portion are then provided. The front wall and preferably the described wall portions extend over the (entire) width of the sifter, and thus, from one side wall to the other side wall.

In one preferred refinement the inclined upper front wall or its inclined wall portion is at an angle of less than 20°, preferably less than 15°, to the vertical. This front wall or its inclined wall portion is therefore more steeply oriented than in the prior art according to EP 0 798 359, so that overall, the classification chamber within the sifter may be enlarged, and thus, the separation quality of the sifter may be improved. This means that undesirable particles having a fairly small size and low weight can be separated out. In addition, the capacity of the sifter is increased, so that a higher material throughput per meter of sifter width may be achieved.

In one preferred refinement, there is an option for adjusting the upper front wall or at least one wall portion, for example the inclined wall portion, to the vertical so that the angle of inclination is settable. In this way, the classification zone is adapted to the particular application. Thus, for example, for applications in which particularly high demands are not imposed on the sifter performance, the classification zone may be reduced in size in order to operate with more energy efficiency. When high demands are imposed on the sifter performance (for example, for the manufacture of very thin panels having a thickness of up to 3 mm, or also for the manufacture of rubberwood material), the classification zone may be enlarged in the described manner by a steep inclination of the front wall.

According to another proposed approach, the air inlet extends continuously over (essentially) the entire width of the housing. Whereas in the prior art, generally multiple adjacently air inlets or multiple adjacently air lines are connected to the housing, the invention proposes supplying the classifying air via a single uniform air inlet that extends over the entire width, and correspondingly, a process air connector that extends over the entire width. This embodiment may be implemented for the upper air inlet and also for the lower air inlet. The adaptation of the supplied air quantity may then be varied for an air inlet via a single flap, so that a simple, more rapid adjustment of the air quantities is achievable. Optionally, at the sides of the air lines it is possible to increase the flow velocity in the edge area via specialized air baffles.

As described above, two air inlets one above the other are preferably provided. The invention preferably proposes that between the upper (upper) air inlet and the lower (lower) air inlet is a lower front wall that has a (convexly) curved design or has at least one (convexly) curved section. The term "convex" here once again means toward the exterior of the housing. The front wall is preferably configured in such a way that a support vortex forms in the inner space between the upper air inlet and the lower air inlet, and supports the upper air stream entering through the upper air inlet. With a targeted design of the sifter, a support vortex thus forms between the upper air line and the lower air line and ensures that the upper air stream is stabilized under different loading values or fluctuating charging quantities.

In addition, optionally a partition divides the classifying chamber (at least in part) into an inlet compartment and an outlet compartment in the housing. This partition, as described in EP 0 798 359, may have a pivotable design as an adjustment flap, so that the geometry of the classifying chamber may be changed. According to the invention, however, it is optionally possible for the partition to be adjustable or changeable in height along the vertical direction of the housing. This partition, also referred to as a blade, and preferably in the center of the sifter, forms a baffle for the fibers, so that the fibers are guided around this baffle to the air outlet. The height adjustment allows the extent to which the sifter projects to be adjusted. The effectiveness of the separation at different tonnages may be varied or increased in this way.

The housing of the sifter according to the invention has the above-described exhaust-air outlet via which the air that is supplied via the air inlet together with the particle-carrying stream is discharged. An exhaust air line is usually connected to this air outlet. This exhaust air line preferably has a deflecting curve connected to the exhaust-air outlet and that extends over a deflection angle of at least 150°, preferably at least 170°, for example approximately 180°. This deflecting curve is then preferably adjoined by a material sorting gate.

Due to the centrifugal forces that occur, a division into a fiber-air mixture on the one hand and air on the other hand takes place in this deflection area, so that a certain air quantity can be separated from the fiber quantity. The overall system thus operates more energy efficiently since a smaller volume of air is further transported off by a ventilator with an open impeller. The power requirements on the shaft are thus reduced. The separated quantity of air is resupplied to the sifter(s) via a ventilator with a closed impeller, and optionally mixed with fresh air beforehand. The invention thus utilizes the known principle of division of the material stream, basically known from U.S. Pat. No. 5,725,102, but transfers same to a sifter that operates solely by gravimetric means.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
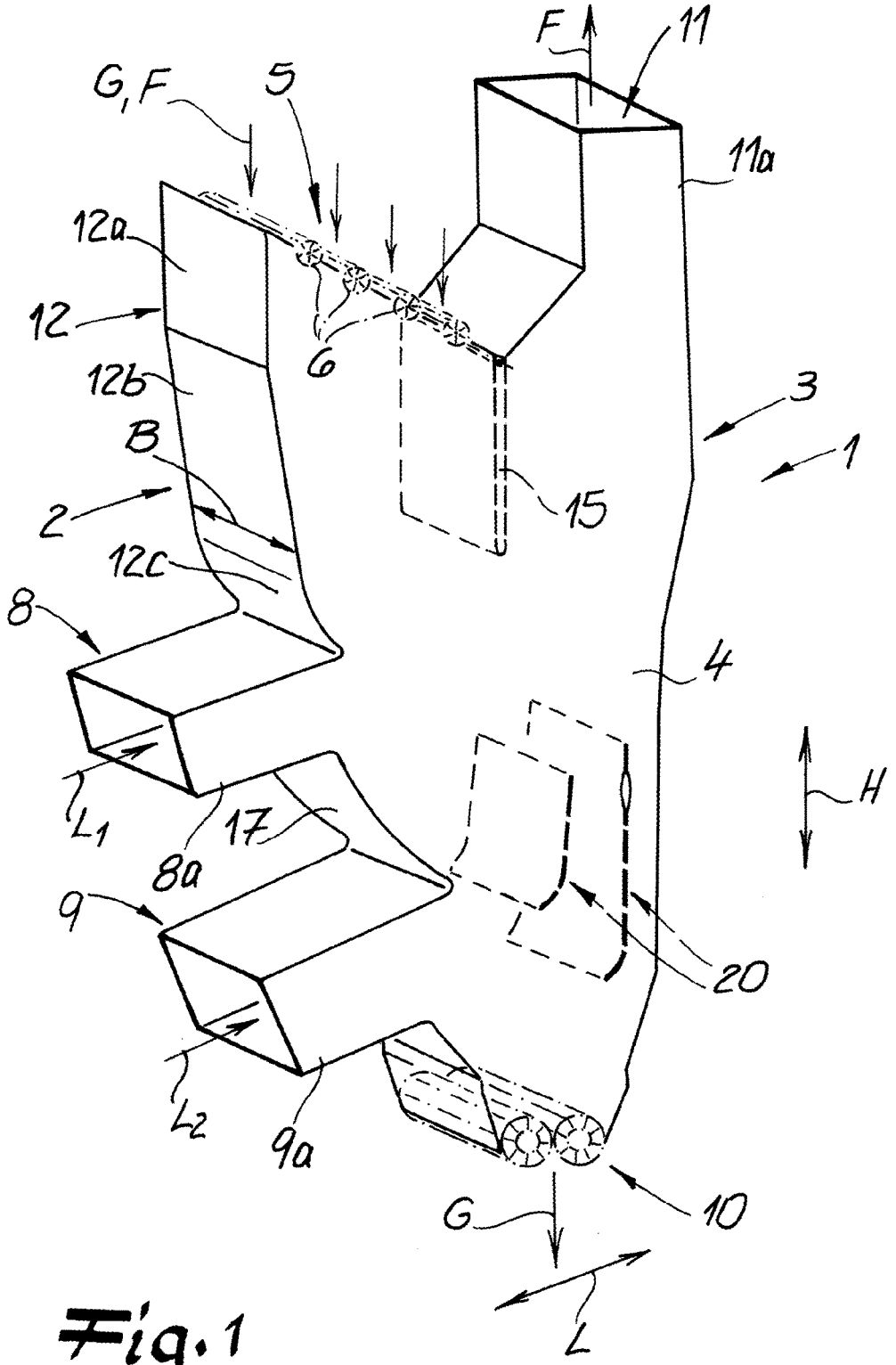
FIG. 1 is a largely schematic perspective view of a sifter according to the invention.

As seen in the drawing, the sifter of this invention serves for separating coarse particles from a particle-carrying air stream, in particular a fiber stream, during the manufacture of wood material panels, in particular wood fiber panels. Such a sifter is preferably integrated into a facility for manufacturing wood material panels, in particular to remove undesirable components (for example, bits of metal, clumps of adhesive, coarse fibers, rust flecks, or the like) from a material stream (of glued fibers, for example), in particular primarily to prevent damage of downstream facilities or facility parts, for example, steel belts of a continuously operating wood material panel press.

The sifter has a sifter housing 1 that in its basic design has an upright front wall 2, an upright rear wall 3 spaced from but generally parallel thereto, and two side walls 4 defining a generally closed treatment chamber 7. The terms front wall 2 and rear wall 3 refer to the main flow direction of the inflowing classifying air from front to rear. The housing 1 on its upper side has an upwardly open material inlet port 5 through which an air stream G carrying glued fibers F, for example, is introduced from a dryer, for example, after gluing. Particle-separating elements, for example rollers 6 as in above-cited EP 0 795 395 that are indicated schematically in the figures, may be in the area of the material inlet 5 or also above or below the material inlet. The fibers F pass into the chamber 7 of the housing 1 via the material inlet 5.

The housing 1 has a upper, upper air inlet port 8 in the front wall 2 below the material inlet 5 to which is fed an air stream carrying fine particles, mainly fibers F, and coarse particles G. In the illustrated embodiment, a lower, lower air inlet port 9 is below the upper air inlet port 8. This upper air inlet 8 is formed by a process air connector 8*a* to which a process air line 8*b* is connected. The lower air inlet 9 is formed by a process air connector 9*a* to which a lower process air line 9*b* is connected. A coarse-particle outlet 10 is provided on the housing 1 below the air inlets 8 and 9, i.e. at the lower end of the housing 1.

An upper clean-air stream $L_1$ is fed in via the upper air inlet 8 so that the fibers F entering via the material inlet 5 are entrained by this air stream $L_1$ and transported upward into the area of the exhaust-air outlet 11 that is formed by an upwardly open exhaust air connector 11*a* to which an exhaust air line 11*b* is connected. The coarse particles G, for example metal or rubber particles, are not entrained by the air stream $L_1$ into the area of the exhaust-air outlet 11, and instead fall downward into the area of the coarse-particle outlet 10 where they are transported away through a gate formed by a pair of meshing rollers, for example (not illustrated).

A lower clean-air stream $L_2$ enters through the lower inlet port 9 to optimize classifying efficiency in the manner described in above-cited EP 0 798 359.

In the illustrated embodiment, an upper front wall 12 that is above the upper air inlet 8 and that therefore extends up to the area of the material inlet 5, is oriented at an angle to the vertical over at least its lower portion. The drawing shows one embodiment in which the upper front wall 12 has a vertically oriented upper wall portion 12*a*, and therebelow, a lower wall portion 12*b* that is inclined at a small acute angle $\alpha$ to the vertical and forming a slightly acute angle with the horizontal flow direction of the air stream $L_1$. Here, this (middle) wall portion 12*b* merges into a (convexly) curved (lower) guide wall portion 12*c* that extends down to the upper air inlet 8. In a side view, an upper edge 13 of the air inlet port 8 projects by an amount M horizontally inward beyond a lower edge 14 of the air inlet port 8. In the side view of FIG. 2, the upper edge 13 is consequently further to the right by the distance M, and thus, further inward into the chamber 7 of the sifter housing 1. The illustrated design prevents particles, and in particular material to be removed, from passing through the air inlet 8 into the process air line 8*b* or the process air connector 8*a*. This has the advantage that fittings, protective grills, or the like may be dispensed with in the area of the air inlet 8 or the inlet connector 8*a* or the air line 8*b*, so that the air inlet 8 has a completely clear cross section without fittings.

The design of the upper air inlet 8 is similarly implemented for the lower air inlet 9. There as well, the upper edge of the air inlet 9 projects with respect to the lower edge by an distance inward toward the chamber 7. Fittings or the like are also dispensed with in the air inlet 9 and its adjacent conduits 9*a-c*.

Moreover, it is apparent in the drawing that the upper front wall 12 or its inclined wall portion 12*b* is at a relatively acute angle α of less than 20° to the vertical. The classifying chamber 7 may thus be bigger than in the prior art. A horizontal dimension or length X of the classification zone along the longitudinal and horizontal overall flow direction L of the sifter extends (essentially) from the upper edge 13 of the air inlet 8 to the lower end of a partition 15, illustrated in particular in FIG. 2 in the housing 1. This partition 15, starting from the upper end of the sifter housing 1 in an essentially vertical orientation, is approximately in the center of the chamber 7 of the housing 1, in particular between the two side walls 4. Such a baffle or partition 15, known in principle, guides the fibers to the air outlet 11. This partition 15 may be adjusted longitudinally parallel to the direction L of the sifter in a basically known manner, in that it is pivotable about a horizontal axis 16, for example. Alternatively or additionally, there is an option for the partition 15 to be adjustable or changeable with respect to height in a transverse vertical direction H. As a result, the amount Y by which the partition projects downward into the chamber 7 of the housing 1 may be adjusted, and the effectiveness of the separation at different tonnages may be adapted and increased in this way.

Figure 3:
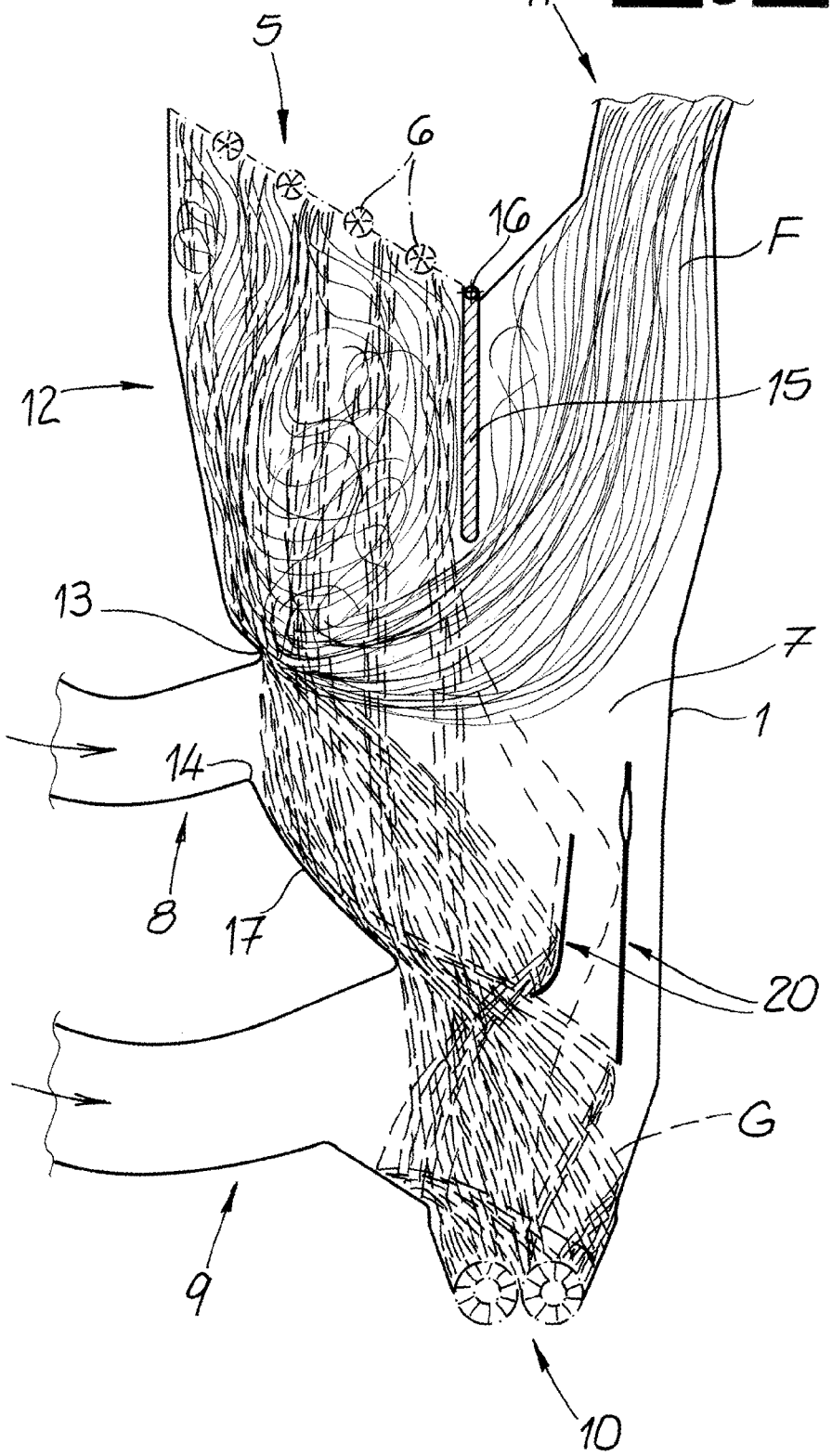
FIG. 3 is a schematic diagram showing particle flow (broken lines) and fiber flow (solid lines) in the inventive sifter.
Figure 4:
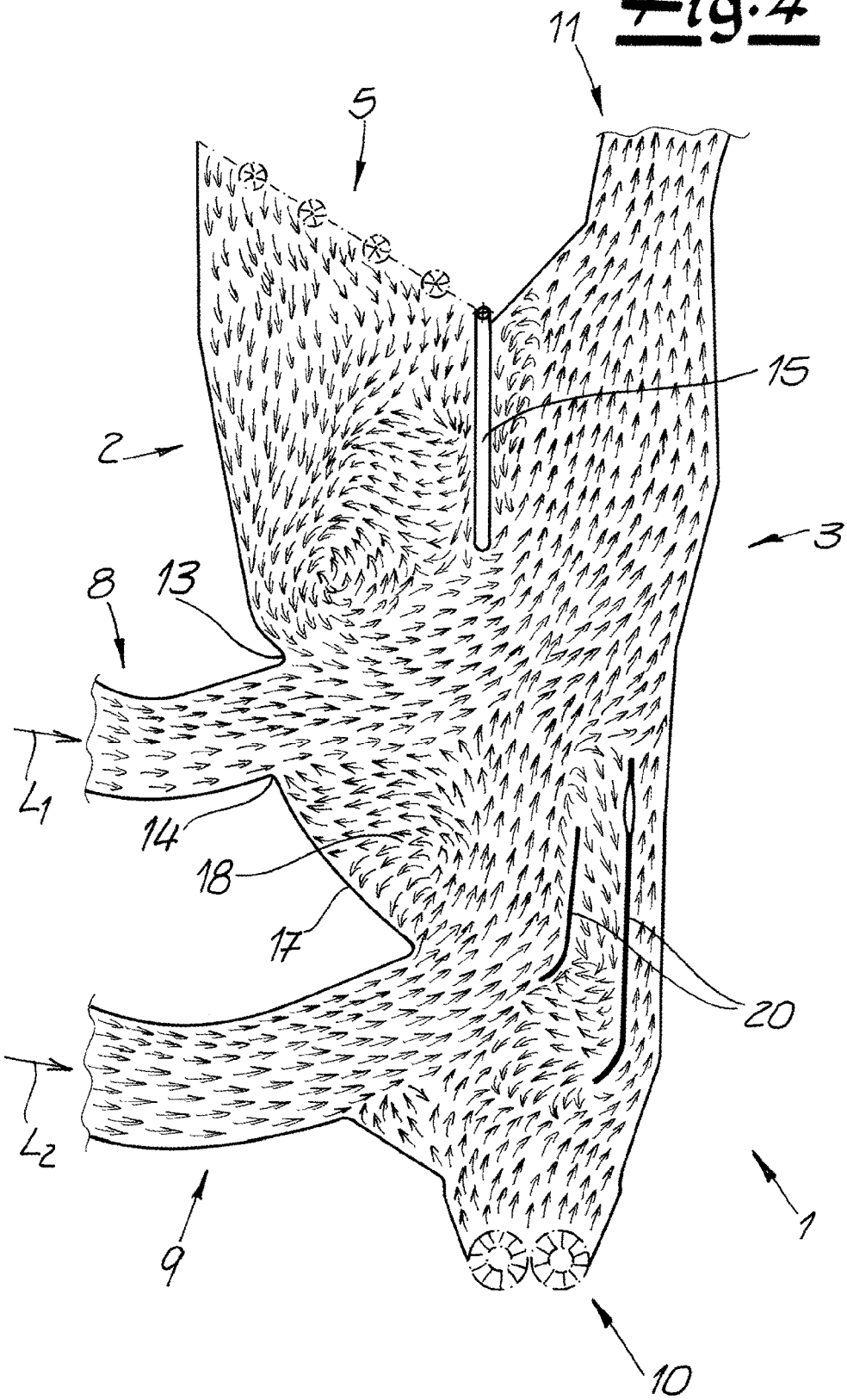
FIG. 4 is a view like FIG. 3 but showing air flow in the sifter according to the invention.

In addition, a lower front wall 17 is between the upper air inlet 8 and the lower air inlet 9. Here, the lower front wall is curved, preferably concave inward toward the chamber 7. Thus a support vortex 18 forms in the chamber 7 between the upper air inlet 8 and the lower air inlet 9, and supports the upper air stream $L_1$ entering through the upper air inlet 8. The flow conditions are schematically indicated in FIG. 4, while FIG. 3 shows in simplified form the path of the fibers F on the one hand, and of the coarse material on the other hand. In this regard, it is preferably provided that (at least) the lower process air connector 9*a* rises at an angle with respect to the horizontal, so that the lower process air stream $L_2$ enters the chamber 7 of the housing 1 in an upwardly inclined orientation with respect to the horizontal. In the illustrated embodiment, the upper process air connector 8*a* is also oriented slightly upward at an angle with respect to the horizontal, so that the upper process air stream $L_1$ also enters the inner space in an upwardly inclined orientation with respect to the horizontal.

Moreover, FIG. 1 shows that the air inlet 8 as well as the air inlet 9, and therefore also the corresponding process air connectors 8*a* and 9*a*, extend (essentially) over the entire horizontal width B of the housing 1. Thus, in contrast to the prior art, operations are not carried out using multiple separate process air lines over the width, but instead, in each case a process air line or supply conduit 8*b* or 9*b* extends over the entire width B of the housing 1.

The air inlet 8 and also the air inlet 9 preferably are of rectangular cross section. The same applies for the process air connectors 8*a* and 9*a* connected to the housing 1. The process air lines 8*b* and 9*b* may have a circular cross section, and may be connected to the process air connectors 8*a* and 9*a* via corresponding transition pieces or adapters 8*c* and 9*c*.

Figure 2:
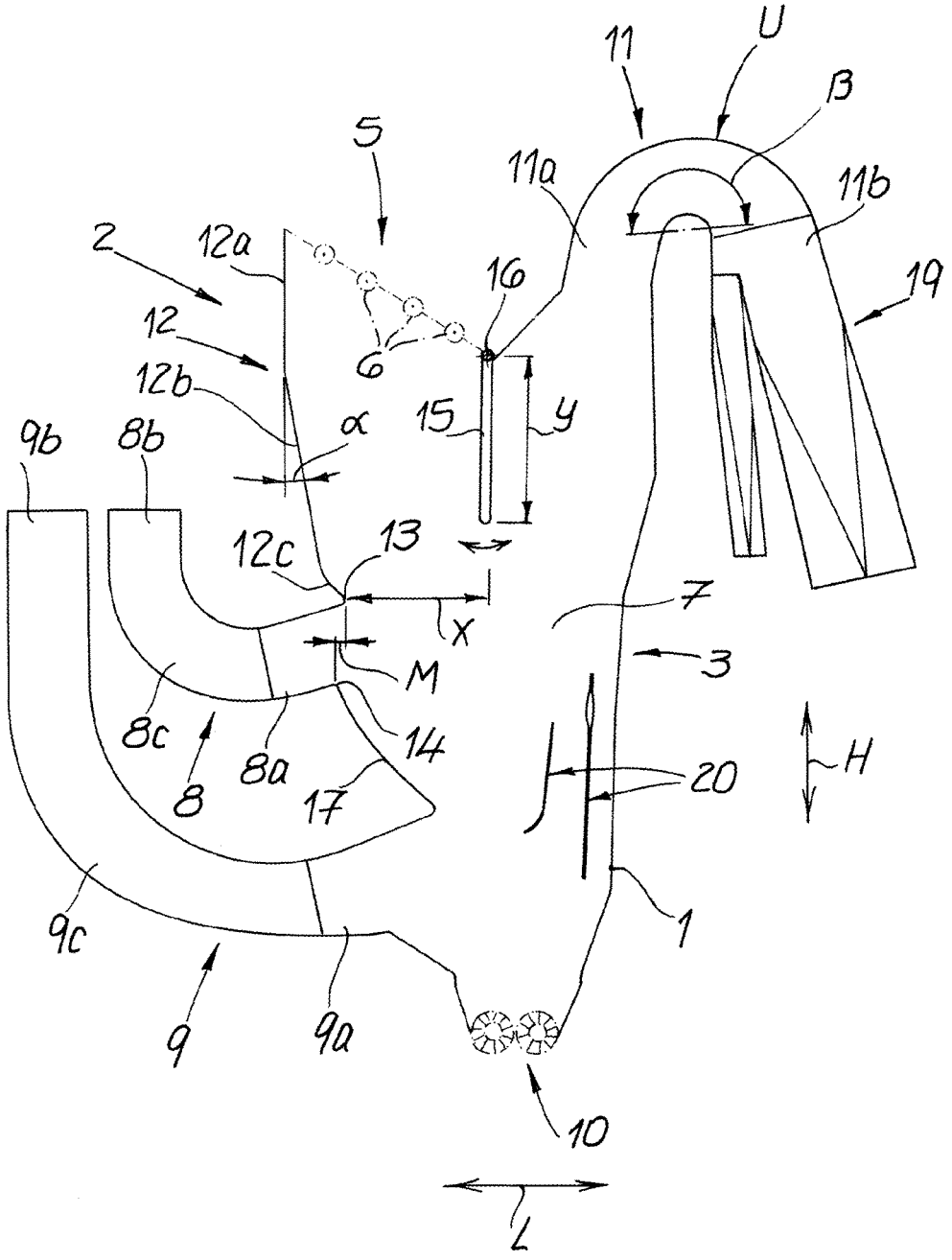
FIG. 2 is a simplified vertical section of the sifter of this invention.

It is also apparent in FIG. 2 that the exhaust air line 11*b* connected to the exhaust-air outlet 11, has a deflecting curve U or is designed as a deflecting curve, in particular having a deflection angle β of approximately 180° through which the air stream and fibers exiting the housing 1 pass. Connected to this deflecting curve is a material sorting gate 19 that divides the fiber-air stream exiting from the air outlet 11 into a fiber-air stream and an air-only stream.

Finally, the drawing shows that additional baffles 20 may be in the chamber 7 of the housing 1. However, such fittings in the sifter may be reduced compared to the prior art, so that the tendency toward fouling is decreased, and the overall effectiveness of the sifter (with regard to separation quality and energy efficiency) may be optimized

We claim:

1. A sifter for separating coarse particles from a particle-carrying stream during the manufacture of wood fiber panels, the sifter comprising a housing forming a chamber and having a material inlet for admitting the particle-carrying stream downwardly to the chamber, a front wall having an upper wall portion extending downward from the material inlet and upwardly delimiting an upper air inlet below the material inlet for admitting a respective upper air stream to the chamber and a lower wall portion extending down from the upper air inlet and upwardly delimiting a lower air inlet below the upper air inlet for admitting a respective lower air stream to the chamber, an upper edge of the upper air inlet in side view being vertically aligned above a lower edge of the upper air inlet or projecting into the chamber beyond the lower edge, an exhaust-air outlet for conveying air and fine particles from the chamber, and a coarse-particle outlet for conveying coarse particles out of the chamber, the lower wall portion being inwardly concave so as to form inside the housing a support vortex that supports the upper air stream entering through the upper air inlet in the chamber of the housing between the upper air inlet and the lower air inlet.

2. The sifter defined in claim 1, wherein the upper wall portion of the front wall of the classifier housing above the upper air inlet is oriented at least partially at an angle to the vertical.

3. The sifter defined in claim 1, further comprising:

an air connector connected to the upper air inlet, rising at an angle with respect to the horizontal, and generating the upper air stream that enters the interior with an upwardly inclined orientation to the horizontal.

4. The sifter defined in claim 1, further comprising:

a lower air connector connected to the lower air inlet, rising at an angle with respect to the horizontal, and generating a lower air stream that enters the interior with an upwardly inclined orientation with respect to the horizontal.

5. The sifter defined in claim 1, wherein the upper wall portion of the front wall extends at an angle of less than 20° to the vertical.

6. The sifter defined in claim 1, wherein the upper wall portion of the front wall is curved and adjoins an upper edge of the upper air inlet.

7. The sifter defined in claim 1, wherein an upper edge of the lower air inlet in side view is vertically aligned above the lower edge of the lower air inlet or projects into the chamber beyond the lower edge.

8. The sifter defined in claim 1, wherein the upper air inlet and the lower air inlet have a free and unobstructed inflow cross section into the chamber of the housing.

9. The sifter defined in claim 1, wherein the upper air inlet and the lower air inlet extend continuously over essentially an entire width of the housing.

10. The sifter defined in claim 1, wherein the front wall is convex toward the exterior between the upper and lower air inlets.

* * * * *